United States Patent [19]

Lilley

[11] Patent Number: 4,867,867

[45] Date of Patent: Sep. 19, 1989

[54] RECOVERY IN THE PHOSPHATE ORE DOUBLE FLOTATION PROCESS

[75] Inventor: Geroge M. Lilley, Lakeland, Fla.

[73] Assignee: J. Warren Allen, Lithia, Fla.

[21] Appl. No.: 597,113

[22] Filed: Apr. 5, 1984

[51] Int. Cl.[4] ..... B03D 1/14

[52] U.S. Cl. ..... 209/166; 209/5; 209/167

[58] Field of Search ..... 209/166, 167, 5; 252/61

[56] References Cited

U.S. PATENT DOCUMENTS

| | | | |
|---|---|---|---|
| 3,097,162 | 7/1963 | Baarson et al. | 209/166 |
| 3,462,016 | 8/1969 | Bushell et al. | 209/166 |
| 4,436,616 | 3/1984 | Dufour et al. | 209/167 |

*Primary Examiner*—Bernard Nozick

*Attorney, Agent, or Firm*—Frijouf, Rust & Pyle

[57] ABSTRACT

This invention relates to a method of enhanced recovery of phosphate in the double flotation process for the benefication of phosphate ore, more particularly to the use of pH modifiers-silica depressants:

sodium silicate;

soda ash ($Na_2CO_3$); or soda silicate and soda ash, alone or in combination with one or more ingredients selected from the group consisting of: starch, dextrin, sodium sulfite and trisodium phosphate, added to the casutic or ammonia reagent used to prepare the patty acid-fuel oil mixture in the first stage of the double flotation process.

2 Claims, 2 Drawing Sheets

RECOVERY IN THE PHOSPHATE ORE DOUBLE FLOTATION PROCESS

DESCRIPTION OF THE PRIOR ART

The conventional double flotation process comprises forming an aqueous pulp of deslimed phosphate containing material and subjecting the aqueous pulp to flotation with an anionic flotation reagent (usually fatty acid mixed with fuel oil) to collect and float from the aqueous pulp a rougher concentrate containing the desired phosphate mixed with some of the siliceous gangue. The rougher concentrate is then deoiled with sulfuric acid, to remove the anionic reagent; it is then washed and subjected to a second flotation with a cationic reagent (amine and kerosene) to collect and float therefrom most of the aforementioned siliceous gangue contained in the rougher concentrate. This overfloat or "tailings" is discarded. The underflow from the second stage comprises a high grade commercially valuable phosphate concentrate.

The primary reagent (fatty-acids) has been used in the first stage float since the beginning of phosphate flotation. It has to be blended with fuel oil to make it a fluid product so it can be pumped to plant. Its purpose is to make a good separation of phosphate from siliceous material. If too much silica floats in the first stage, it becomes difficult to make a high grade product in the second stage float. Furthermore, it is more expensive since it requires more amine reagent to float the excess silica in the second stage. Fatty acid and fuel oil suppliers have produced and blended reagents to make them stronger and more selective. They have had some success but more improvement is needed.

One disadvantage with the present double float process is, that as the concentration of the fatty acid-fuel oil is increased to insure high phosphate recovery, more silica floats over with it. This in turn requires the use of more cationic reagent at the conditioning stage 40 in order to remove the excess silica.

Therefore, it is the object of this invention to provide a method for improving the yield and grade of phosphate recovered in a conventional phosphate double flotation process by the addition of:

sodium silicate;

soda ash; or sodium silicate and soda ash alone or in combination with one or more ingredients selected from the group consisting of: starch, dextrin, sodium sulfite and trisodium phosphate, to the caustic and/or ammonia reagent.

Another object of this invention is to provide a higher grade rougher concentrate in the first float, that is, less siliceous material in rougher concentrate.

Another object of this invention is to require less cationic reagent (amine) in the second flotation step and produce a higher yield of the desired product.

SUMMARY OF THE INVENTION

In accordance with the present invention, the first stage of the double flotation process is modified by the addition of:

sodium silicate;

soda ash; or sodium silicate and soda ash alone or in combination with one or more ingredients selected from the group consisting of: starch, dextrin, sodium sulfite and trisodium phosphate, to the caustic and/or ammonia reagent.

The resultant caustic and/or ammonia blend in accordance with the invention results in a higher grade and yield than the conventional double float process. The pH modifier blend will vary, i.e., the specific relative amounts are dependent on particular flotation ore processed to produce the best results.

BRIEF DESCRIPTION OF THE DRAWINGS

For a fuller understanding of the nature and objects of the invention, reference should be made to the following detailed description taken in connection with the accompanying drawings in which.

Figure 2:
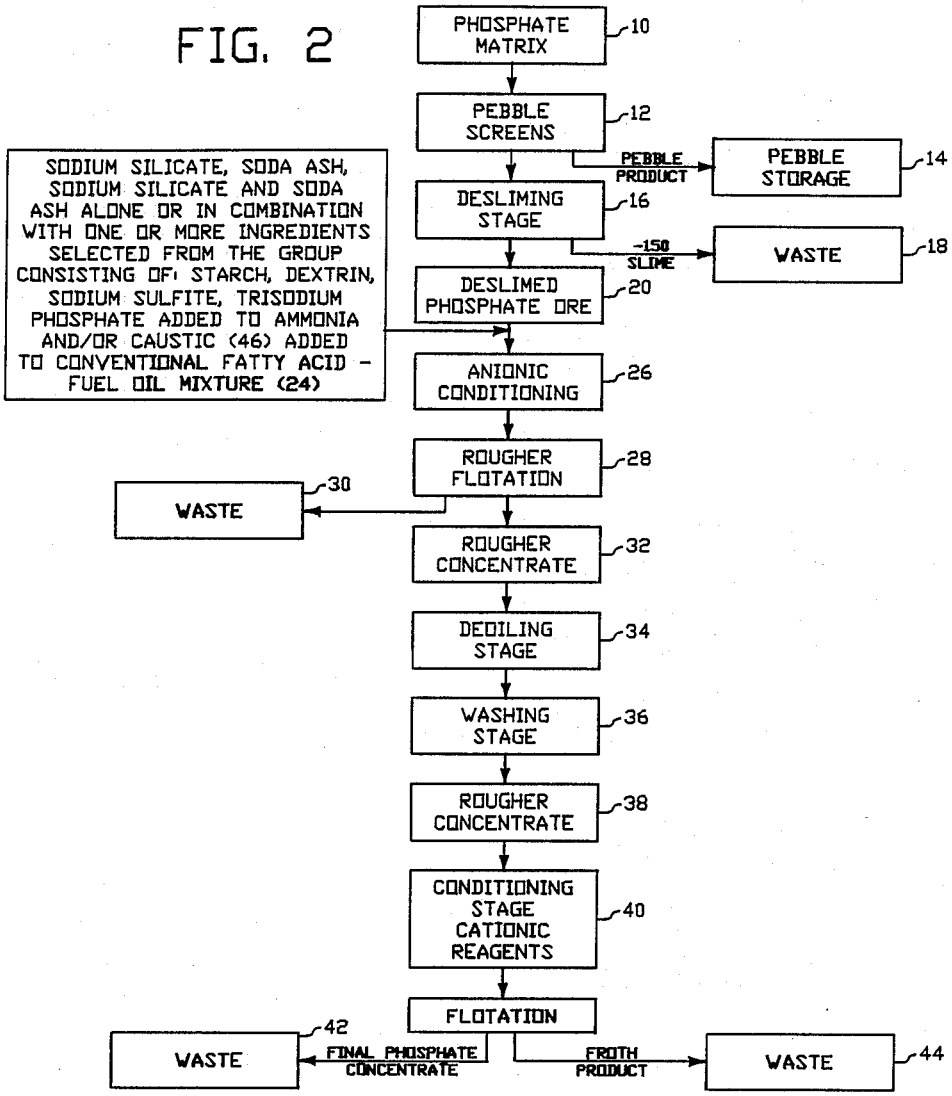
FIG. 2 is a flow diagram of the present invention. The invention follows the conventional double flotation process, except in the first stage reagent 22 of FIG. 1, is modified to contain.

sodium silicate, soda ash, or sodium silicate and soda ash alone or in combination with one or more ingredients selected from the group consisting of: starch, dextrin, sodium sulfite and trisodium phosphate. The modified reagent 46 (FIG. 2) is then mixed with the standard or conventional fuel oil-fatty acid mixture 24.

DETAILED DESCRIPTION

In the conventional double flotation process for phosphate recovery, a chemical reagent 22 [caustic and/or ammonia] is used in the conditioning stage of the first float to raise the conditioning pulp 26 to an alkaline pH of about 8.5–9.5. This allows the anionic reagents [fatty acid with fuel oil] to properly coat the desired phosphate particle for the float separation of phosphate from the undesired siliceous gangue material. The desired result is to recover as much phosphate in the overfloat without siliceous gangue contamination. Most of the refinement of the double flotation process has been with an anionic reagents, i.e., the fatty acid-fuel oil mixture, however, very little work has been done to produce a more effective pH modifier/depressant.

Figure 1:
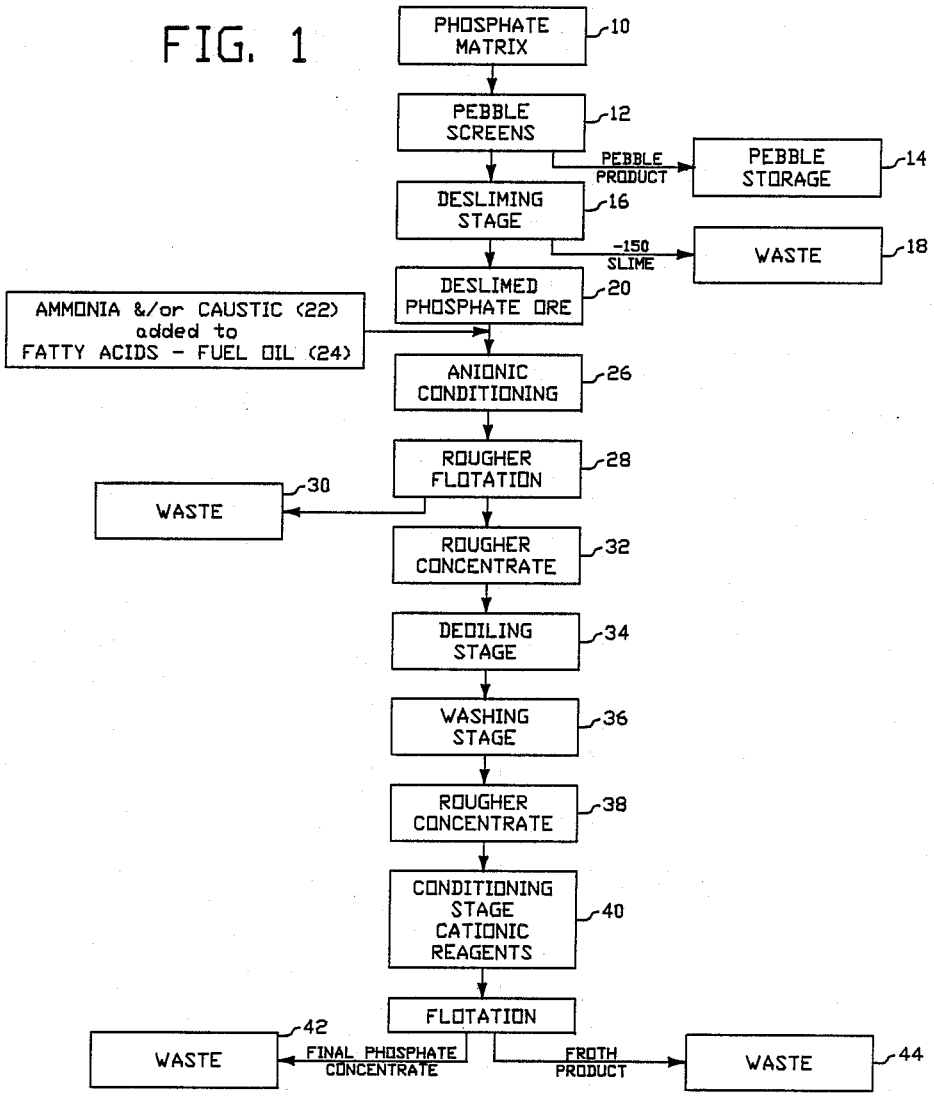
FIG. 1 is a flow chart of the conventional double flotation process. Phosphate deposits known as phosphate matrix 20 are a mixture of larger lumps of phosphate material [usually referred to as pebble rock] phosphate rock particles, sand, clay, organic matter and similar gangue materials. In order to recover the phosphate, the phosphate matrix or ore feed 10 is first washed and screened 12 to separate and recover the pebble rock 14. The double flotation process is then used to concentrate the phosphate from the undersize or fines typically −20 to +150 mesh, from the first wash [desliming stage 16]. The material passing through the 150 mesh screen is called "slimes" and contains mostly clay, silica and phosphate. The slime is typically discarded 18 in the conventional double float process. The commerical double float process concentrates phosphate in two stages of froth flotation. In the first stage the deslimed phosphate ore 20 [usually 12–25 percent BPL (bone phosphate of lime or $Ca_3(PO_4)_2$) and 70–80 percent insoluble] is treated in an anionic stage 26 by a reagent 22 such as sodium hydroxide and/or ammonia added to reagent 24: fatty acids and fuel oil. The mixture is passed through a rougher flotation 28 wherein the underfloat known as "rougher tailings" is discarded and pumped to waste 30. The desired phosphate ore or overfloat known as "rougher concentrate" 32 [45–60 percent BPL and percent 18–35 insoluble] is deoiled with sulfuric acid 34, washed 36 and prepared for the second stage of flotation. The rougher concentrate 38 is then treated with a cationic reagent [amine and kerosene] at conditioning stage 40, to float off insolubles to make a final high grade concentration 42 [70–75 percent BPL and 3–5 percent insoluble]. The float product in the second stage, known as amine tailings, is discarded and pumped to waste 44.

This invention is based on the discovery that by modifying reagent 22 [FIG. 1] by the addition of:

sodium silicate, soda ash, or sodium silicate and soda ash alone or in combination with one or more ingredients selected from the group consisting of: sodium sulfite, trisodium phosphate, dextrin and starch being added to caustic and/or ammonia will greatly improve the performance of the anionic agent resulting in a flotation product having a greater yield of phosphate and a higher grade of phosphate. The blending percentage will vary with each type of ore processed and therefore cannot be set to specific limits. This percentage can be readily ascertained by one skilled in the art by ordinary experimentation.

The present invention is illustrated by the following examples:

SODIUM SILICATE AND STARCH

EXAMPLE I 500 grams of phosphate ore are treated with caustic, 0.5 lbs fatty acid, 0.5 lbs fuel oil, conditioned for two min. and floated in lab float cell.

| Test No. | Products | % Weight | % BPL | % INS. | % BPL Recovery |
|---|---|---|---|---|---|
| 1 | Rou. Conc. | 21.8 | 63.62 | 14.84 | 80.2 |
| | Rou. Tails | 78.2 | 4.39 | — | 19.8 |
| Test 2 is the same as test No. 1 except the caustic was blended with sodium silicate and starch | | | | | |
| 2 | Rou. Conc. | 23.4 | 65.48 | 11.51 | 89.9 |

-continued

| Test No. | Products | % Weight | % BPL | % INS. | % BPL Recovery |
|---|---|---|---|---|---|
| | Rou. Tails | 76.6 | 2.24 | — | 10.1 |

EXAMPLE II 500 grams of phosphate ore are treated with 0.4 lbs of ammonia, 0.7 lbs fatty acid, 0.7 lbs fuel oil, conditioned for two min. and floated in lab float cell.

| Test No. | Products | % Weight | % BPL | % INS. | % BPL Recovery |
|---|---|---|---|---|---|
| 3 | Rou. Conc. | 27.3 | 42.50 | 42.59 | 90.8 |
| | Rou. Tails | 72.7 | 1.62 | — | 9.2 |
| Test No. 4 is the same as test No. 3 except the ammonia was blended with sodium silicate and starch. | | | | | |
| 4 | Rou. Conc. | 20.5 | 59.71 | 19.65 | 93.2 |
| | Rou. Tails | 79.5 | 1.12 | — | 6.8 |

For this particular ore about 60% caustic/ammonia, 30% sodium silicate and 10% starch were used. However, these percents will vary and are selectable by one skilled in the art. The invention is embraced in the combination.

SODIUM SILICATE

When sodium silicate is added to caustic and/or ammonia [new soap blend] both a higher grade and percentage recovery is achieved relative to the standard fatty acid-fuel oil and/or fatty acid ammonia or caustic mixtures as illustrated:

| Test | Lbs/Ton Feed | | Rougher Tails | | Rougher Concentrate | | | |
|---|---|---|---|---|---|---|---|---|
| Type | F.A. | F.O. | % Wt. | % BPL | % Wt. | % BPL | % Ins. | % BPL Recovery |
| EXAMPLE I | | | | | | | | |
| Std. F.A/F.O.* Blend | 0.90 | 0.90 | 68.5 | 3.11 | 31.5 | 62.75 | 12.34 | 90.3 |
| New Soap Blend | 0.70 | 0.70 | 68.7 | 2.17 | 31.3 | 65.63 | 10.71 | 93.2 |
| EXAMPLE II | | | | | | | | |
| Std. F.A/F.O. Blend | 1.00 | 1.00 | 65.3 | 1.51 | 34.7 | 64.02 | 15.12 | 95.8 |
| New Soap Blend | 1.00 | 1.00 | 67.0 | 0.48 | 33.0 | 67.85 | 10.01 | 98.6 |
| EXAMPLE III | | | | | | | | |
| Std. F.A/F.O. Blend | 0.90 | 0.90 | 55.0 | 4.77 | 45.0 | 38.48 | 46.11 | 86.9 |
| New Soap Blend | 0.70 | 0.70 | 64.6 | 1.02 | 35.4 | 56.08 | 21.77 | 96.8 |
| EXAMPLE IV | | | | | | | | |
| Std. F.A/F.O. Blend | 0.90 | 0.90 | 57.2 | 3.10 | 42.8 | 47.36 | 35.30 | 92.0 |
| New Soap Blend | 0.70 | 0.70 | 66.9 | 1.14 | 33.1 | 64.32 | 12.63 | 96.6 |

*fatty acid-fuel oil

For this particular ore about 30% sodium silicate was used.

SODA ASH AND DEXTRIN

EXAMPLE I 500 grams of phosphate ore are treated with caustic, 0.8 lbs. fatty acid, 0.8 lbs. fuel oil, conditioned for two minutes and floated in lab float cell.

| Test 1 | Products | % Weight | % BPL | % Ins | % BPL Recovery |
|---|---|---|---|---|---|
| 1 | Rou. Conc. | 32.3 | 61.75 | 17.72 | 78.2 |
| | Rou. Tails | 67.7 | 8.23 | — | 21.8 |
| Test 2 | Same as Test No. 1 except the caustic was blended with soda ash. | | | | |
| | Products | % Weight | % BPL | % Ins | % BPL Recovery |

-continued

| | | | | | |
|---|---|---|---|---|---|
| 2 | Rou. Conc. | 34.1 | 63.84 | 14.81 | 85.5 |
| | Rou. Tails | 65.9 | 5.62 | — | 14.5 |
| Test 3 | Same as Test No. 2 except the caustic was blended with soda ash and dextrin | | | | |
| | Products | % Weight | % BPL | % Ins | % BPL Recovery |
| 3 | Rou. Conc. | 34.1 | 64.01 | 14.00 | 86.4 |
| | Rou. Tails | 65.9 | 5.23 | — | 13.6 |

EXAMPLE II 500 grams of phosphate ore are treated with ammonia, 0.8 lbs. fatty acid, 0.8 lbs. fuel oil, conditioned for two minutes and floated in lab float cell.

| Test 4 | Products | % Weight | % BPL | % INS | % BPL Recovery |
|---|---|---|---|---|---|
| 4 | Rou. Conc. | 37.2 | 60.16 | 20.00 | 87.6 |
| | Rou. Tails | 62.8 | 5.06 | — | 12.4 |
| Test 5 | Same as Test No. 4 except the ammonia was blended with soda ash. | | | | |
| | Products | % Weight | % BPL | % Ins | % BPL Recoverey |
| 2 | Rou. Conc. | 37.1 | 62.44 | 18.03 | 90.5 |
| | Rou. Tails | 62.9 | 3.84 | — | 9.5 |
| Test 6 | Same as Test No. 3 except the ammonia was blended with soda ash and dextrin | | | | |
| | Products | % Weight | % BPL | % Ins | % BPL Recovery |
| 3 | Rou. Conc. | 37.2 | 63.47 | 17.18 | 91.7 |
| | Rou. Tails | 62.8 | 3.41 | — | 8.3 |

For this particular ore about 60% caustic/ammonia, 30% soda ash and 10% starch were used. Where soda ash was used alone, about 30% was used.

The improved phosphate [BPL] recovery and grade is illustrated by the above examples which clearly show that the performance of the caustic and/or ammonia reagent is greatly improved by the addition of the pH modifiers/depressants according to the invention.

From the foregoing description of enhanced phosphate recovery it will be seen that an important contribution to the art of the benefication of phosphatic materials has been made.

What is claimed is:

1. In the double stage flotation process for the benefication of phosphate ore comprising forming an aqueous pulp of deslimed phosphate ore containing material, subjecting said aqueous pulp to a first flotation with an anionic flotation reagent, comprising an agent selected from the group consisting of:

sodium hydroxide or ammonia, mixed with fatty acid and fuel oil, to collect and float from said aqueous pulp and overfloat rougher concentrate containing the desired phosphate mixed with some of the silicious grange, discarding the underfloat or rougher tailings, deoiling the rougher concentrate to remove the anionic reagent, washing the resultant deoiled rougher concentrate and submit said deoiled rougher concentrate to a second flotation with a cationic reagent comprising an amine and kerosene to collect an overfloat from said deoiled rougher concentrate most of the silicious grange contained in the rougher concentrate and discarding same, to collect the underfloat which comprises a phosphate concentrate, wherein the improvement comprises the addition of sodium silicate and starch to the sodium hydroxide or ammonia reagent used to prepare the fatty acid-fuel oil mixture used in the first stage flotation anionic conditioning.

2. In the double stage flotation process for the benefication of phosphate ore comprising forming an aqueous pulp of deslimed phosphate ore containing material, subjecting said aqueous pulp to a first flotation with an anionic flotation reagent, comprising an agent selected from the group consisting of:

sodium hydroxide or ammonia, mixed with fatty acid and fuel oil, to collect and float from said aqueous pulp and overfloat rougher concentrate containing the desired phosphate mixed with some of the silicious grange, discarding the underfloat or rougher tailings, deoiling the rougher concentrate to remove the anionic reagent, washing the resultant deoiled rougher concentrate and submit said deoiled rougher concentrate to a second flotation with a cationic reagent comprising an amine and kerosene to collect an overfloat from said deoiled rougher concentrate most of the silicious grange contained in the rougher concentrate and discarding same, to collect the underfloat which comprises a phosphate concentrate, wherein the improvement comprises the addition of sodium carbonate and an agent selected from the group consisting of starch or dextrin to the sodium hydroxide or ammonia reagent used to prepare the fatty acid-fuel oil mixture used in the first stage flotation anionic conditioning.

* * * * *